United States Patent [19]

Belmondo

[11] Patent Number: 5,076,721

[45] Date of Patent: Dec. 31, 1991

[54] WRITING INSTRUMENT CAP SUITABLE TO LET A FLOW OF AIR PASS THROUGH IT

[75] Inventor: Domenico Belmondo, Mappano, Italy

[73] Assignee: Dobell, S.p.A., Turino, Italy

[21] Appl. No.: 496,889

[22] Filed: Mar. 21, 1990

Related U.S. Application Data

[63] Continuation-in-part of Ser. No. 310,393, Feb. 14, 1989, abandoned.

[30] Foreign Application Priority Data

Feb. 29, 1988 [IT] Italy ..... 20749/88[U]

[51] Int. Cl.[5] ..... B43K 5/00

[52] U.S. Cl. ..... 401/202; 401/213; 401/243

[58] Field of Search ..... 401/202, 213, 243

[56] References Cited

U.S. PATENT DOCUMENTS 4,969,766 11/1990 Nagle et al. ..... 401/202

FOREIGN PATENT DOCUMENTS 2174374 11/1986 United Kingdom ..... 401/243

2220199 12/1989 United Kingdom ..... 401/213

*Primary Examiner*—Richard J. Apley

*Assistant Examiner*—D. F. Crosby

[57] ABSTRACT

A writing instrument cap having a tubular lower section suitable to embrace a cylindrical body of a writing instrument. An upper section of the cap is formed by a central tubular core and is closed on its top. The upper section receives a writing point of the writing instrument to make an airtight seal. The outer surface of the central tubular core has a plurality of outwardly projecting radial fins whose outer edges define a prolongation of an outer wall of the lower tubular section. The circumference of those fins accounts for less than one-half of the circumference of this prolongation of the outer wall. A plurality of clearances permit the rectilinear flow of air through the cap. Channels are formed between adjoining radial fins, and the cross-sectional area of the clearances is in excess of one-half of the total cross-sectional area between the outer surface of the central tubular core and the prolongation of the outer wall.

4 Claims, 1 Drawing Sheet

WRITING INSTRUMENT CAP SUITABLE TO LET A FLOW OF AIR PASS THROUGH IT

CROSS REFERENCE TO RELATED APPLICATIONS

This Application is a continuation in part of U.S. Pat. application Ser. No. 07/310,393 filed on Feb. 14, 1989, now abandoned, in the name of Domenico Belmondo and entitled Writing instrument cap suitable to let a flow of air pass through it.

BACKGROUND OF THE INVENTION

As it is known, the children are instinctively in the habit to put into their mouth any object they can have on hand, seriously risking that said objects could be swallowed, obstructing the respiratory tract. In this last case there can be deadly consequences provided if is not possible to have at one's disposal a medical aid in a very short lapse of time.

Among the various objects that are widespread to day and even offered to children to enjoy themselves, writing instruments have to be included such as felt pens, ballpoint pens and the like, the most dangerous part of which is constituted by the closing cap that has dimensions limited enough it could be easily swallowed. For this reason the manufactures of writing instruments are engaged to provide suitable means to prevent the suffocation of children who swallowed such caps, allowing an even limited flow of air such as to consent to breath during a lapse of time sufficient for the intervention of medical personnel able to carry out the elimination of the occlusion.

GB Patent Application No. 2,174,374 to Balls discloses a hollow detachable closure cap for the container of a liquid or paste product comprising an open ended base constituting locating means for the cap on the container and a part with a closed end extending axially from the base; the part being formed with external longitudinally extending ribs separated by recesses; the base wall of at least one of the recesses adjacent the base being formed with a longitudinal slot and the end of the part nearest its closed end constituting a seal for the container.

A serious drawback of this closure cap is the fact that the slots are obtained in the circumferential face of the substantially cylindral part of the cap joining the two ends.

As a consequence, only with a truncated cone cap a negligeable part of the air, coming in from the bottom open end, could follow a straight path and come out through the lateral slots to keep in touch with the outer wall of the cap between the recesses obtained between two adjacent openings.

The remaining air coming in from the opening at the cap base, which is most of it, is sent to the cap holes through tortuous paths.

On the other hand, if the cap is cylindrical, all the air coming in from the base would come out of the slots through tortuous paths.

On the contrary it is fundamental for the air coming in from the base, all or most of it, to follow a straight path as it has to reach as quickly as possible, and in the largest quantity over possible, the throat of the person who has swallowed.

SUMMARY OF THE INVENTION

Should the air follow a tortuous and turbolent path, the cap would be no use at all, because the person would be unable to breath a sufficient amount of air through the cap holes and that is what happens with the cap described in the above mentioned English patent application where almost all air has necessarily to follow a tortuous and turbolent path.

The purpose of the invention is therefore to provide a writing instrument cap with integral structure that allows to all the flow of air to follow a straight path whilst accomplishing its normal task to protect the writing point and to realize an airtight seal of the same to prevent the ink getting dry, above all in the case of the felt pens.

According to the invention, the cap is constituted of an integral structure comprising a tubular lower section suitable to embrace the cylindrical body of the writing instrument and of an upper section formed by a central tubular core, also called small valve, closed on the top and suitable to receive the writing point of the writing instrument, making an airtight seal around the end portion of the writing instrument which holds the point itself.

The outer surface of the core or small valve has outwardly projecting radial fins, the outer edges of which constitute the prolongation of the outer face of the lower tubular section, the connection between the lower section and the upper one being such as to form clearances or open spaces of about 20–30 $mm^2$, through the inner space of the lower section and the channels formed between adjoining radial fins, to let a flow of air pass long a straight path.

BRIEF DESCRIPTION OF THE DRAWINGS

The invention will now be described by the following description with reference to the accompanying drawings, given as an example and not as a restrictive embodiment, in which.

DETAILED DESCRIPTION OF THE INVENTION

Figure 1:
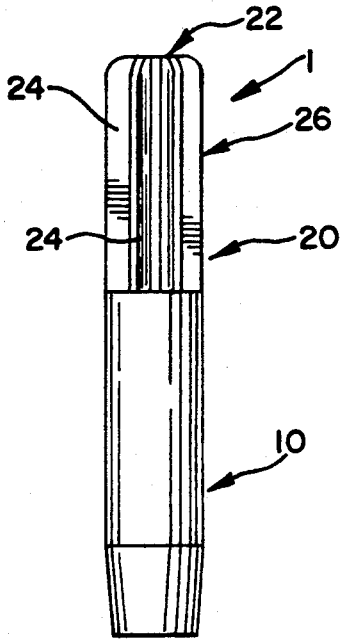
FIG. 1 shows a front view of the cap according to the invention, in scaled-up size.
Figure 2:
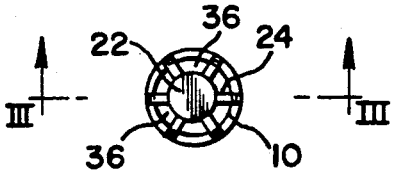
FIG. 2 shows a top view of the cap of FIG. 1.
Figure 3:
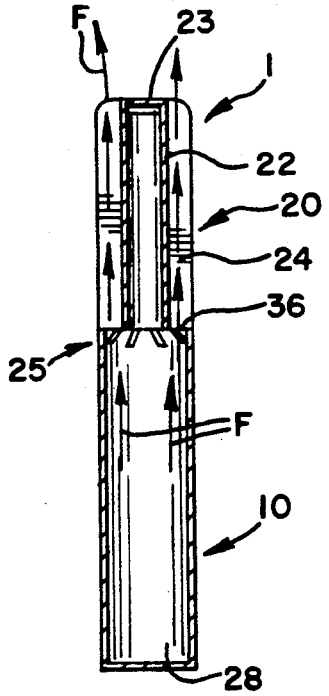
FIG. 3 shows a cross section of the cap along the line III—III of FIG. 2.

Referring to FIGS. 1, 2 and 3, the cap indicated as a whole with 1, is constituted of an intrgral body, preferably moulded in a single piece of plastic material, comprising a tubular shaped lower section 10 and an upper section formed by a central core 22, also called small valve, closed on the top at 23. An upwardly-tapered connecting section 25 secures and serves as a transitional element between the lower section 10 and the upper section 22. The upwardly-tapered section 27 has a plurality of clearances or open spaces 36 which permit the rectilinear flow of air through the cap. Many radial fins 24 project outwardly from the small valve 22, in the example show there being six fins, which are regularly spaced between each other and, at their bottom end, connected at position 25 to the inner wall of the lower tubular section 10, such fins being thus able to keep the small valve 22 firmly linked to the said lower section.

The free edge 26 of the fins is preferably placed as a prolungation of the outer wall of the tubular section 10.

Figure 4:
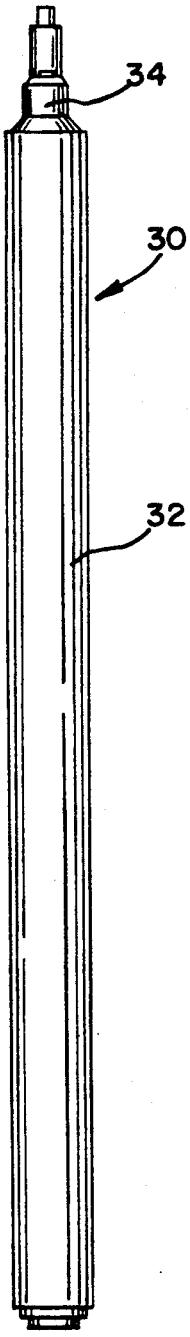
FIG. 4 shows the body of a writin instrument to which the cap according to the invention can be coupled.

Referring to FIG. 4, showing a writing instrument example 30, the inner diameter of the tubular section 10 will be obviously proportioned to the diameter of the writing instrument body 32 while the inner diameter of the small valve 22 will be such as to realize an airtight seal at the end portion 34, holding the writing point of the writing instrument.

From what said and described it results evident, in particular from FIGS. 2 and 3, that many air passages 36 become available through the inner space 28 of the section 10 and the channels formed among the fins 24 so to leave a sufficient possibility of rectilinear air flow for breathing, as indicated by the arrows F, in the case that this writing instrument cap is stuck in the windpipe by anyone of its ends.

A cap according to the invention, having e.g. a normal inner diameter of the tubular section 10 of about 8 mm. provides a section of about 20 square $mm^2$ available for the rectilinear flow of the air.

It is fundamental, however, the fact that in the cap according to the invention the air coming in from the base, all or most of it, follows a straight path to reach as quickly as possible and the largest quantity over possible the throat of the person who has swallowed the cap.

I claim:

1. A writing instrument cap characterized in that it is constituted of an integral structure comprising a tubular lower section suitable to embrace a cylindrical body of the writing instrument, an upper section formed by a central tubular core or small valve, said upper section having a top and being closed on its top, said upper section being suitable to receive a writing point of the writing instrument and to make an airtight seal around an end portion of the writing instrument which holds said writing point, said small valve including an outer surface, the outer surface of said small valve having a plurality of outwardly projecting radial fins the outer edges of which constitute the prolongation of an outer wall of the lower tubular section, the circumferential extent of said fins accounting for less than one-half of the circumference of said prolongation of said outer wall, and a plurality of clearances or open spaces to permit the rectilinear flow of air through said cap, and a plurality of channels formed between adjoining radial fins, the cross-sectional area of said clearances being in excess of one-half of the total cross-sectional area between the outer surface of said small valve and the prolongation of said outer wall.

2. A writing cap, comprising a tubular lower section having an inner wall and an outer wall; an upper section having a central tubular core (22), said upper section having a diameter less than said tubular lower section and being open only at its lower end; said upper section including a plurality of outwardly projecting radial fins with outer edges, the circumferential extent of said fins accounting for less than one-half of the circumference of the prolongation of said outer wall; and having a plurality of clearances or open spaces to permit the rectilinear flow of air through said cap, the cross-sectional area of said clearances being in excess of one-half of the total cross-sectional area between the outer surface of said tubular core and the prolongation of said outer wall; the lower end of said tubular upper section engaging a body of said writing instrument to create an airtight seal within said tubular upper section for a writing point of said writing instrument.

3. The writing instrument cap of claim 2, wherein said cap is molded in a single piece.

4. The writing instrument cap of claim 2, wherein said radial fins are secured to said inner wall of said lower section.

* * * * *